US005379977A

United States Patent [19]

Rönn et al.

[11] Patent Number: 5,379,977

[45] Date of Patent: Jan. 10, 1995

[54] ARRANGEMENT FOR RAISING AND LOWERING A VERTICALLY SUSPENDED UNIT

[75] Inventors: Per G. Rönn, Bålsta; Leif Svedberg, Kungsängen, both of Sweden

[73] Assignee: Per Gunnar Ronn AB, Kungsangen, Sweden

[21] Appl. No.: 1,861

[22] Filed: Jan. 8, 1993

[30] Foreign Application Priority Data

Jan. 10, 1992 [SE] Sweden ..... 9200067-8

[51] Int. Cl.[6] ..... E04G 3/00

[52] U.S. Cl. ..... 248/277; 248/324; 248/327

[58] Field of Search ..... 248/277, 323, 324, 325, 248/327, 331, 317, 917; 211/117; 187/18

[56] References Cited

U.S. PATENT DOCUMENTS

| | | | |
|---|---|---|---|
| 241,416 | 5/1881 | Porter | 248/324 |
| 736,609 | 8/1903 | Langdon | 248/277 |
| 2,933,198 | 4/1960 | Firestone et al. | 248/324 UX |
| 3,034,765 | 5/1962 | Ludowici | 187/18 X |
| 3,672,104 | 6/1972 | Luckey | 248/177 X |
| 3,795,289 | 3/1974 | Laforest | 187/18 |
| 3,950,050 | 4/1986 | Kinder | 312/247 |
| 5,261,645 | 11/1993 | Huffman | 248/277 X |

FOREIGN PATENT DOCUMENTS 2648799 6/1989 France .

*Primary Examiner*—Ramon O. Ramirez

*Attorney, Agent, or Firm*—Morgan & Finnegan

[57] ABSTRACT

The invention relates to an arrangement for vertically raising and lowering a unit, e.g. a plate, a monitor or the like, suspended from a support, comprising a retractable member consisting of at least three interconnected lazy tongs linkages, an upper attachment connected to the upper part of said retractablela member and to the support, a lower attachment connected to the lower part of said retractable member and to the unit, connectors pivotally secured at joints between two interconnected lazy tongs linkages, thereby interconnecting at least three lazy tongs linkages to form said retractable member, and means for assumin the lateral movements occuring when the unit is retracted or extended, said means being provided at each end of said retractable member and in said lower and upper attachements, respectively, and consisting of bore members having bores formed therein, and beam like members received in said bore members, whereby said movements assuming means extend towards the centre of said lower and upper attachments, respectively.

5 Claims, 5 Drawing Sheets

Fig. 1
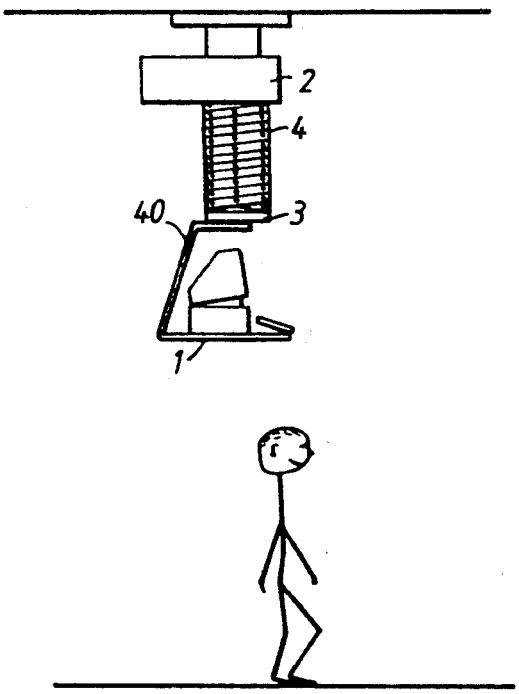
Fig. 2
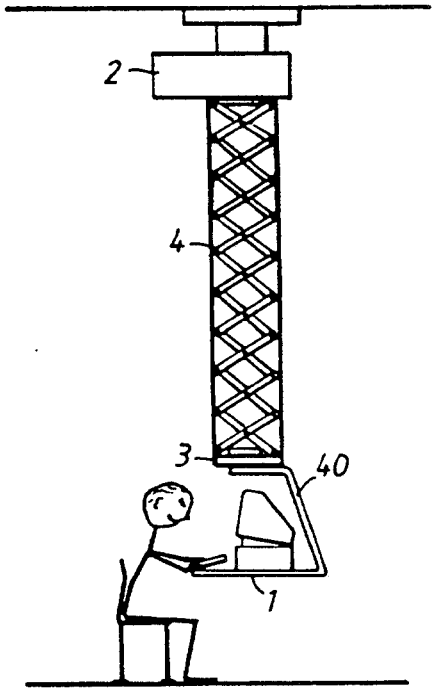
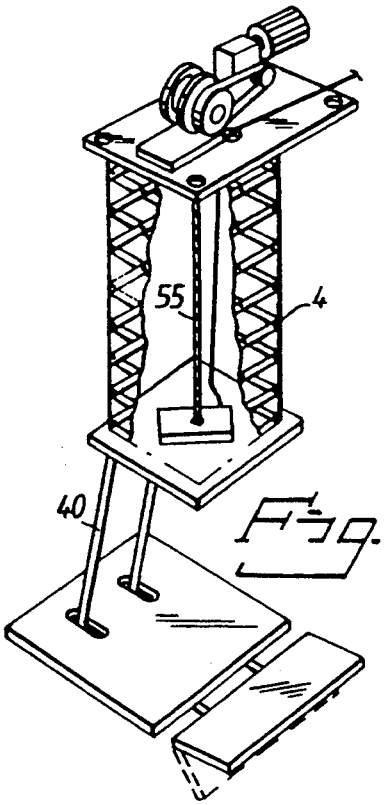
Fig. 3
Fig. 4
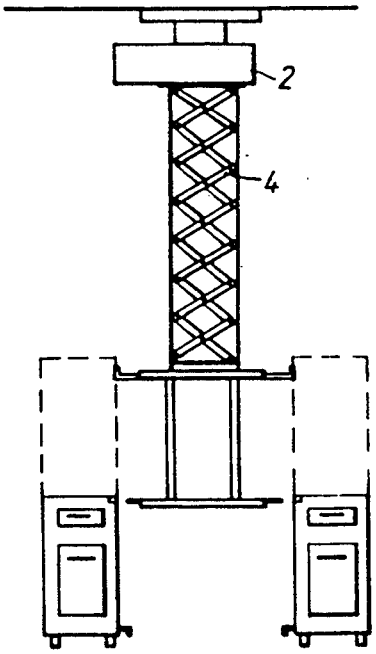

ARRANGEMENT FOR RAISING AND LOWERING A VERTICALLY SUSPENDED UNIT

The present application relates to an arrangement for vertically raising and lowering a unit, e.g. a plate, a monitor or the like, suspended from a support. The plate is intended to form, for example, a release surface or space, or the base of a working place or the like.

There are vertically adjustable plates, substantially horizontal, for use as release surfaces, working surfaces such as writing desks, mounting tables, terminal tables, and so on. These items can rest either on a framework or pedestal on the floor, the pedestal in itself being vertically adjustable, or on some form of brackets sliding in guides mounted on a wall or some other suitable vertical mounting place, or they are mounted on selfrigid vertically arranged guides. All these structures bring with them the inconvenience that it is hard to make the floor surface under these plates available when the plate is not needed. Either the floor surface is blocked, as in the case of the vertically movable plate on a pedestal, or one is confined, when locating the plate, to those places in the room where guides with associated brackets can be mounted.

As a matter of course, one could also conceive a vertically movable plate suspended by a cable winch or a hydraulic piston-cylinder device or some arrangement comparable therewith. In order to impart stability to a plate provided with a cable winch it should be absolutely necessary to provide the plate with one or more legs to be unfolded when needed, in order to stabilize the plate when it is to be used as a working place. The hydraulic device of the kind stated above will be too uneconomical.

The present invention has for its object to provide an arrangement of the kink initially mentioned above which can be placed at liberty in the room, that is, placing is not confined to places suitable for securing guides and the like, and which neither has to rest on a pedestal in order to provide a plate which is stable vertically as well as laterally, and also stable against torsional action, i.e the suspension has to be stiff in torsion as well as in bending.

This object is attained according to the invention by an arrangement having the features of claim 1. Such an arrangement comprises several groups of interconnected rodlike elements provided with apertures for pivot means, whereof two outer apertures are spaced a predetermined distance and at least one intermediate aperture is symmetrically disposed between said outer apertures, said groups of rodlike elements forming one of at least three interconnected "lazy tongs" linkages, whose elements are pivotally connected to each other at each joint, said at least three lazy tongs scissors being interconnected by means of a connector pivotally secured at each adjacent outer joint, so that said at least three united lazy tongs linkages form together a retractable member, said member being connected at either end with said attachments by means of a device assuming the lateral movements occurring when the unit is extended or retracted.

By means of the arrangement according to the invention the plate can be suspended from e.g. a ceiling, a beam, or a crablike device provided for the purpose.

The suspension means of the plates includes an upper attachment and a lower attachment, the first being used for securing the arrangement to a ceiling or the like, whereas the lower one is secured to the unit, e.g. a plate, which is to be suspended. These attachments are joined together by means of a member comprising a plurality of interconnected lazy tongs linkages or scissors. By this term a device is aimed at which comprises a number of elongated rodlike elements crossing each other in pairs and arranged one pair after the other, the elements being pivotally connected at a point somewhere between the ends of each element, to form a X-shaped unit, said elements essentially covering each other when the unit is pushed together. These crosswise connected elements are in turn, at two points located on either side of said connection point of the elements, pivotally connected with at least one further similar unit. Such arrangement of the scissors brings with it that they can be extended very far and, at the same time, they can be pushed together to be dimensionally minimized.

Preferred embodiments of the invention have obtained the characteristic features defined in the subclaims.

The invention will be disclosed in greater detail in the following with reference to the accompanying drawings which show preferred embodiments:

FIG. 1 shows an embodiment of an arrangement according to the invention in its elevated position;

FIG. 2 shows an embodiment of the arrangement in its lowered position;

FIG. 3 shows the arrangement in its lowered position with a plate carried by the arrangement, part thereof being shown removed in order to illustrate a driving device;

FIG. 4 shows the arrangement in a lowered position carrying a plate to which two drawer pedestals or cabinets have been connected;

Figure 5A:
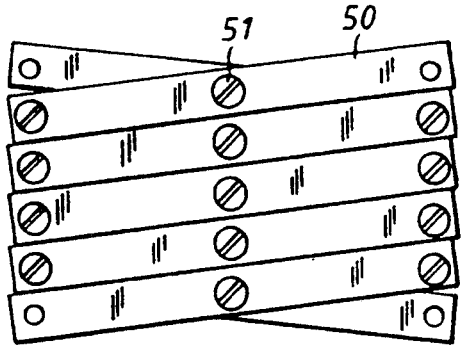
Figure 7:
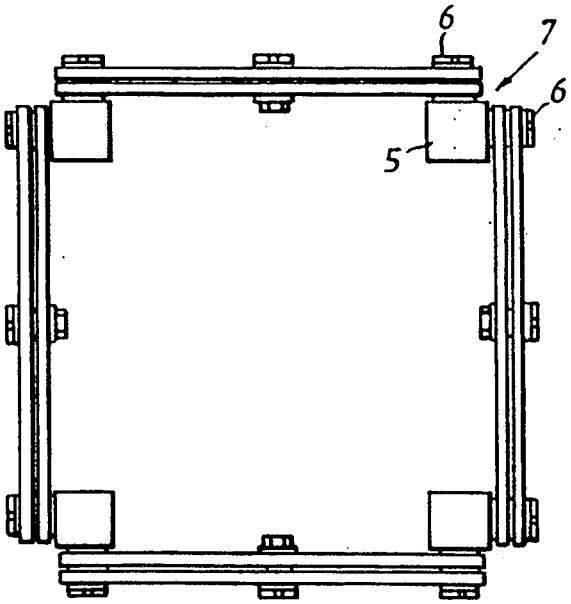
Figure 6A:
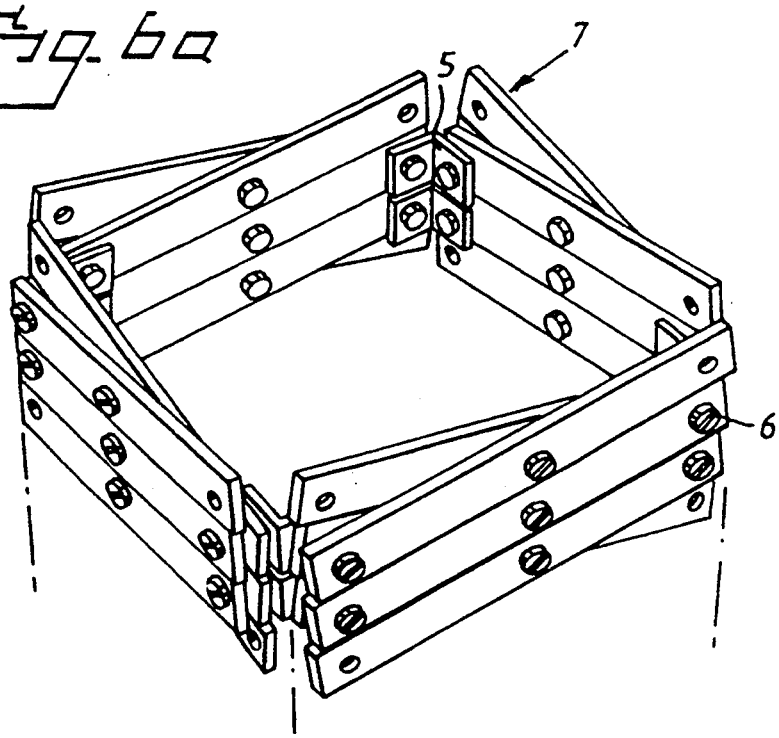
Figure 6B:
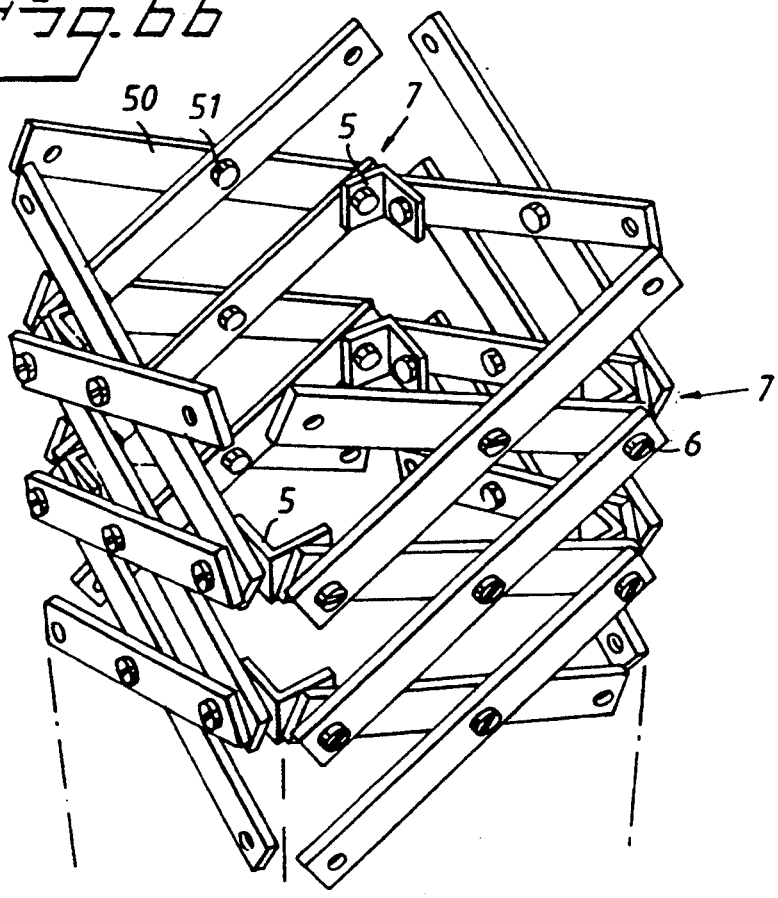
Figure 8:
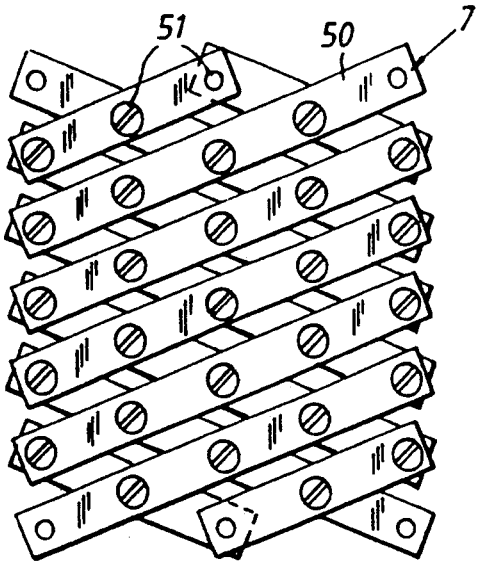
Figure 9:
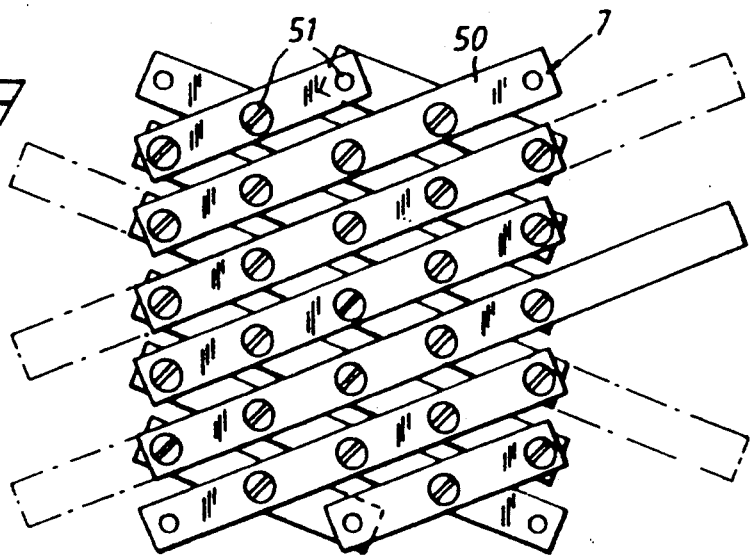
Figure 10:
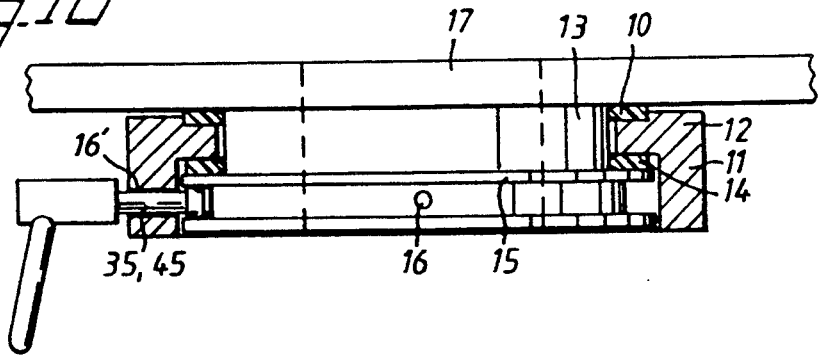
Figure 11:
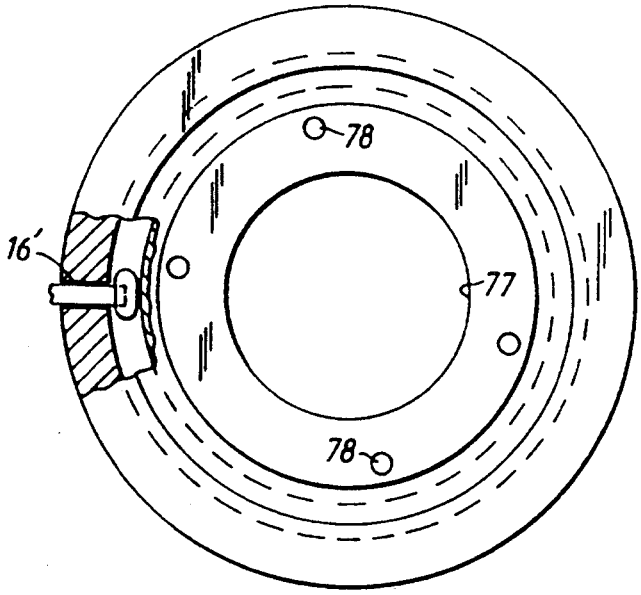
Figure 12:
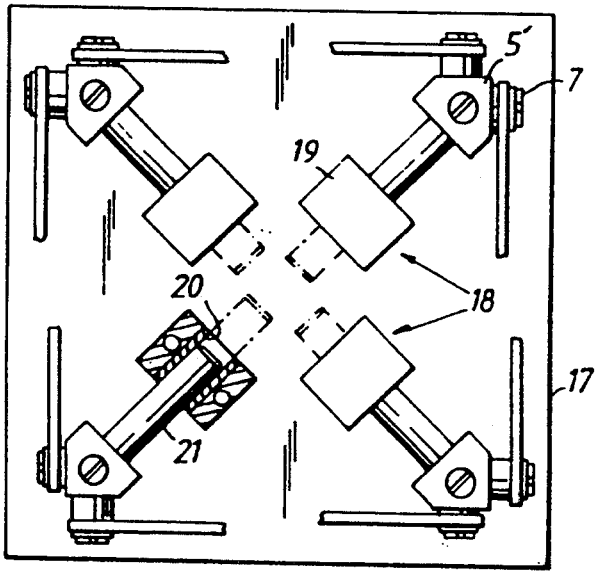
Figure 13:
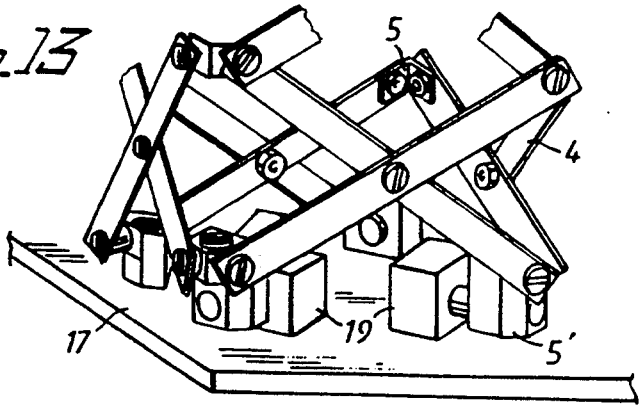

FIGS. 5*a, b*, and *c* show the design of a lazy tongs linkage or scissors component of the arrangement according to the invention, in two different positions and in crossection;

FIGS. 6*a* and *b* show four interconnected lazy tongs scissors in two different positions, said scissors forming together a retractable member of the the arrangement according to the invention;

FIG. 7 shows a plan view of the member in FIG. 6;

FIG. 8 shows an alternative design of the lazy tongs scissors, where each rodlike element is provided with five apertures for receiving pivot means;

FIG. 9 shows an alternative design of the scissors according to FIG. 8;

FIG. 10 shows the design of a rotatable means of a lower attachment component of the arrangement according to the invention;

FIG. 11 shows a plan view, partly in section, of the attachment according to FIG. 10; and FIGS. 12 and 13 show a plan view, partly in section, of that portion of the arrangement which assumes the lateral movements caused by the retracting movements of the member.

In FIGS. 1–4 there is shown a vertically adjustable unit according to the invention, comprising a plate 1, an upper attachment 2, a lower attachment 3 and a member 4, capable of being extended or shut up and connecting said attachments with one another and including four lazy tongs linkages or scissors joined side by side in such a way that they form a square tube like unit having pairs of parallel sides, and one or more suspension arms 40 for the plate 1. The foursided embodiment shown in the drawings has right angled corners.

In addition, there is shown in FIG. 3 how a motor driven cable winch or hoist has been arranged to adjust and arrest the plate on a Illustratively, a counterweight can be provided to assume the weight of the arrangement with the unit for raising and lowering the unit. As a matter of course the vertical level can also be fixed by other means than indirectly by a motor driven winch, for example, by pins or catches locking outer or intermediate pivot points which vertically or horizontally follow one upon the other in the lazy tongs scissors. In FIG. 3 only two of the four scissors have been indicated in order to make visible the cable winch 55 and a device 18 which assumes the lateral movements which occur when the retractable means is extended and shut up. Of course it is also possible to combine three, five or even more scissors, although we have preferred to disclose an embodiment having a combination of four scissors, which has proven suitable.

It is also shown, in FIG. 4, how it is possible, in elevating the unit, to connect a pair of drawer pedestals or cabinets by the plate being brought down to the lower edges of the pedestals, after which the top edges of the pedestals are connected to the arms shown in the drawing, while the lower edges are connected to the plate. These pedestals have a height which is less than the distance of the plate to the uppermost attachment or the ceiling when the plate is elevated.

Figure 5B:
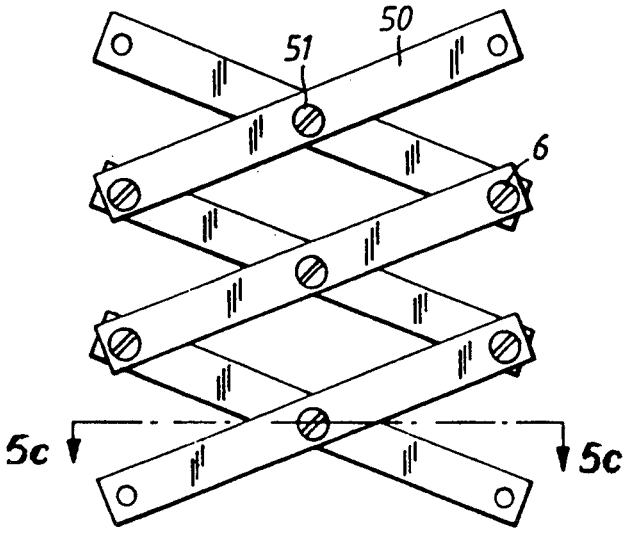
Figure 5C:
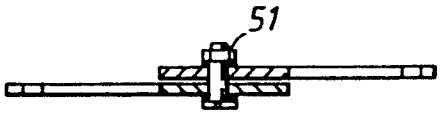

In FIGS. 5–7 the structure of the lazy tongs linkage or scissors used is illustrated. As shown the scissors consist of a combination which comprise a plurality of crossed elongated rodlike elements 50 consecutively arranged and pivotally interconnected at a point 51 between the ends of the elements, to form a X-shaped unit. These crosswise connected elements are in turn each pivotally connected with a subsequent unit at points 6 located at apertures in the ends of elements 50.

In FIGS. 6–7 the point of connection 7 between the various lazy tongs scissors is shown, said point in this case coinciding with connection points 6. In the figures it can be seen how a connecting piece or connector 5 is located in the angle formed between the scissors at the point of connection 7. For practical reasons through holes are provided in the connector 5 wherein are threaded the respective bolts which pivotally connect the X-shaped units of each lazy tongs scissors. Between, respectively, bolt head and rod element, rod element and rod element, and rod element and connector, there are of course inserted washers in a conventional manner for locking the bolts while allowing relative rotation of the rods.

The inwardly directed connectors 5 of the lazy tongs scissors shown in FIGS. 6–7 join the connection points 6 of succesive X-shaped units with the corresponding points on the same level of adjacent scissors. These connectors 5 may consist of blocks of a material suitable for creating sufficient rigidity at the point of connection 7 and thus in the whole member 4. The shape of the corner element need not necessarily be square as shown in FIG. 7, but it can, for example, be triangular or, as in FIGS. 6*a* and *b*, the element can have the shape of an angle bar as long as the conditions of stability are fulfilled.

This design of the lazy tongs structure is suitable with regard to stability and rigidity. Depending on various circumstances, such as the weight of the plate and its load, the desired load capacity, possibly increased rigidity of the structure and so on, the design can be amended so as to combine, as shown in FIGS. 8–9, in the X-unit several elements 50 extending in parallel and which are joined with corresponding elements extending mutually parallel in the opposite direction, and where the elements are pivotally interconnected by fastening means, suitably screw-and-nut joints, in all points 51 where they cross. In addition, it could be advisable to lengthen one or more of the elements 50 so as to extend beyond the point where the X-units are connected together, viz., the point of connection 7 at an outer aperture. This in order to form, for example, a guiding trail for e.g. a cable winch component of the arrangment and used for raising and lowering plate 1.

A coupling arrangement is shown in FIGS. 10–11. It comprises a circular plastic ring 10 located in a groove above a circular annular element 11 provided with an inwardly directed circumferential flange 12 arranged at the top edge of the element. A cylinder 13 having a radius adjusted to allow the cylinder to pass within the inwardly directed flange is adapted to be introduced into the elemnt 11 with an interposed plastic ring 14. At the lower end surface of the cylinder, integral therewith, a further cylinder 15 is provided which has a lower height and a larger diameter than the first mentioned one. On the periphery of cylinder 15 there are one or more hores 15 provided in a circumferential groove. Also this cylinder 15 is introduced into the annular element 11, which is provided with one or more hores 16' corresponding to bores 16 in cylinder 15. In bore 16' a pin 35, possibly spring loaded, is inserted, adapted to engage a bore 16 to lock thereby the combined cylinder body 13, 15. As a matter of course the pin can also be locked e.g. by means of a locking shoulder. It should be pointed out, of course, that the two cylinders do not necessarily have to be made in one piece.

Cylinder 15 can also be provided with a groove along its periphery wherein an expanding member 45 is introduced, by means of which the cylinder body is locked in the desired position.

On the upper central portion, formed by the top surface of cylinder 13, of the coupling arrangement an upper disc 17 is secured by screws. On the opposite side of said disc the lower or the upper attachment for the retractable member 4 is secured, said attachments including a device to assume lateral movements occurring when the unit is extended or shut up. The device 18, see FIGS. 12–13, comprises four blocks 19 mounted on disc 17 in the corners of an imaginary square, the blocks having diagonally arranged bores 20. Shafts 21 secured in modified connectors 5' (see FIG. 13) extend through these bores 20, said connectors being provided at the ends of the retractable member. These particular connectors are twice as high as the other connectors in order to give room to the mounting of said shafts 21. Hereby the the points of connection 7 can move inwards and outwards according as the member is extended or retracted.

At the lower end of the attachment, which end can be considered, in principle, to be represented by the lower edge of the annular element 11, the suspension device for the vertically movable plate 1 is secured, see FIG. 1.

The upper attachment, thus provided at the upper portion of member 4, equals the attachment disclosed for mounting disc 17 on member 4.

The lower attachment is preferably suspending the plate by means of a U-shaped suspension arm 40, see FIG. 3. Other suspension arrangement can of course be considered, depending on the range of application of the plate, but in the present embodiment the structure disclosed has been preferred as it offers maximum freedom in use.

For certain applications it can of course be conceived that the disc of the lower attachment be essentially centrally mounted. Hereby is attained that e.g. a circular supporting surface can be provided.

In FIG. 11 reference character 77 designates an opening in disc 17 and the coupling arrangement for the passage of a possible cable hoist. Such an opening need therefore not be provided when the coupling arrangement is mounted on the lower attachment. 78 designates threaded holes for receiving screws for securing the coupling arrangement on the disc. Threaded holes are of course also provided in element 11 for securing the opposite side of the coupling arrangement.

The invention is not confined to the embodiments disclosed above and shown in the drawings but can be modified within the scope of the appended claims.

What we claim is:

1. An arrangement for vertically raising and lowering a unit suspended from a support, the arrangement comprising:

a retractable member having at least two ends and at least three interconnected lazy tongs linkages having each interconnected rodlike elements, said lazy tongs linkages forming angles at said interconections, said elements having apertures, two outer apertures being spaced a predetermined distance from each other and at least one intermediate aperture being symmetrically disposed between said outer apertures, and pivot means in said outer and intermediate apertures for connecting said lazy tongs linkages to each other at said pivot means, an attachment connected to one of said retractable member ends and to the support, another attachment connected to the other end of said retractable member and to the unit, connectors pivotally secured at said angles formed between each two interconnected lazy tongs linkages, thereby interconnecting at least three lazy tongs linkages to form said retractable member, means for retracting and extending the unit, said retraction and extension means being provided at each of said retractable member ends and in both of said respective attachments, blocks having bores formed therein, and shafts received in said respective bore members, whereby said shafts extend towards the center of said respective attachments.

2. An arrangement according to claim 1, further comprising four interconnected lazy tongs wherein said interconnected rodlike linkages establish a square cross-section.

3. An arrangement according to claim 1, further comprising retracting and extending means for moving one of said attachments and positioning said one attachment at predetermined positions in relation to the other attachment.

4. An arrangement according to claim 1, wherein said retracting and extending means further comprise a cable winch and a motor for driving said cable winch.

5. An arrangement according to claim 1, further comprising locking means for locking said retractable member in predetermined positions, whereby a counterweight assumes the weight of the arrangement with the unit for retracting and extending the unit.

* * * * *